United States Patent [19]

Poe

[11] Patent Number: 4,843,845

[45] Date of Patent: Jul. 4, 1989

[54] PADLOCK SHACKLE AND HASP STAPLE PROTECTOR

[76] Inventor: Lloyd R. Poe, 7341 S. Marina Pacifica Dr., Long Beach, Calif. 90803

[21] Appl. No.: 148,281

[22] Filed: Jan. 25, 1988

[51] Int. Cl.[4] ..... E05B 67/38

[52] U.S. Cl. ..... 70/54; 292/281

[58] Field of Search ..... 70/54–56, 70/51–53, DIG. 56; 292/281

[56] References Cited

U.S. PATENT DOCUMENTS

| | | | |
|---|---|---|---|
| 256,902 | 4/1882 | Kirk | 70/DIG. 56 X |
| 547,550 | 10/1895 | Hopkins | 70/DIG. 56 X |
| 1,244,404 | 10/1917 | Ankovitz | 70/56 |
| 1,248,293 | 11/1917 | Ellington | 70/56 |
| 1,554,592 | 9/1925 | Olson . | |
| 3,392,555 | 7/1968 | Beaver . | |
| 3,590,607 | 7/1971 | Beaver | 292/281 X |
| 3,606,423 | 9/1971 | McCarthy . | |
| 3,652,114 | 3/1972 | Cady | 292/281 |
| 3,727,438 | 4/1973 | Knaack | 70/63 |
| 3,736,016 | 5/1973 | Garvey et al. | 292/281 |
| 3,744,280 | 7/1973 | Brown | 70/54 |
| 3,783,657 | 1/1974 | Foote | 70/54 X |
| 3,800,570 | 4/1974 | Kaplan | 70/18 |
| 3,884,057 | 5/1975 | Maurer | 70/54 X |
| 4,033,155 | 7/1977 | De Lucia | 70/56 |
| 4,106,315 | 8/1978 | Dohanyos | 70/56 |
| 4,141,232 | 2/1979 | Kelly | 70/54 |
| 4,157,653 | 6/1979 | Dohanyos | 70/417 |
| 4,238,941 | 12/1980 | Halopoff | 70/56 |
| 4,380,160 | 4/1983 | Hoffman | 70/56 X |
| 4,576,022 | 3/1986 | Gamble | 70/55 |
| 4,581,907 | 4/1986 | Eberly | 70/54 |
| 4,745,783 | 5/1988 | Poe | 70/54 X |

FOREIGN PATENT DOCUMENTS

| | | | |
|---|---|---|---|
| 82131 | 3/1920 | Australia | 70/55 |
| 344118 | 11/1921 | Fed. Rep. of Germany | 70/55 |
| 348575 | 2/1922 | Fed. Rep. of Germany | 70/54 |
| 413366 | 4/1946 | Italy | 70/55 |
| 8264 | of 1901 | United Kingdom | 70/54 |
| 2185519 | 7/1987 | United Kingdom | 70/54 |

*Primary Examiner*—Lloyd A. Gall

*Attorney, Agent, or Firm*—Fulwider, Patton, Rieber, Lee & Utecht

[57] ABSTRACT

A protector for use with a conventional padlock having a lock body and a shackle of inverted U-shape characterized by a pair of legs shiftable inwardly of the lock body when the padlock is locked, and shiftable outwardly when the padlock is unlocked. With the shackle fitted to a conventional hasp staple, the protector can be placed in protective position over the staple and the unlocked shackle. Moving the protector in a predetermined direction locks the protector to the shackle legs so that the protector cannot be moved outwardly and removed. When the padlock is locked the lock body moves partially into the protector so that the protector cannot be moved oppositely of the predetermined direction for removal until the padlock is unlocked.

6 Claims, 1 Drawing Sheet

PADLOCK SHACKLE AND HASP STAPLE PROTECTOR

TECHNICAL BACKGROUND

The present invention relates to a protector for covering a padlock shackle and the associated hasp staple to deny unauthorized access, and more particularly to such a protector held in place by interengagement with the shackle.

BACKGROUND ART

A typical padlock includes a lock body and a shackle of inverted U-shape which is characterized by a pair of legs shiftable or movable inwardly relative to the lock body to a retracted position to place the padlock in a locked state. The legs are shiftable outwardly to an extended position when the padlock is unlocked.

In the extended position one of the shackle legs termed the "capture" leg is located above and out of engagement with the lock body. This permits the shackle to be pivoted about the other ("pivot") leg to provide clearance for the shackle to be disposed through the hasp staple.

The usual hasp staple includes a U-shape portion which projects through a slot in the hasp when the hasp is located for locking together the hasp part and hasp staple part. These parts would be the complemental parts to be locked together, such as a door frame add a door.

Bolt cutters, chisels, hack saws and similar burglar tools are commonly used by thieves to cut through padlock shackles and hasp staples of the type just described, and various solutions have been advanced in the prior art to defeat this practice.

An obvious solution is to use higher grade steel and heavier cross sections for the shackles and staples, but this adds considerable expense to a locking system, and even these improved components are vulnerable to modern bolt cutters.

One class of devices proposed in the prior art to deter burglars employs specially designed hasp components welded or otherwise fixed to the parts to be locked together. U.S. Pats. Nos. 3,606,423 (McCarthy); 3,727,438 (Knaack); 3,652,114 (Cad et al); 4,581,907 (Eberly); and 3,744,280 (Brown, Jr., et al) describe devices of this type. However, the use of such special hasps greatly increases the cost of a security installation, and some of the hasps are so intricately interfitted that some degree of prior knowledge is required to properly position the padlock for locking and unlocking.

U.S. Pats. Nos. 3,392,555 (Beaver); 4,157,653 (Dohanyos); and 3,736,016 (Garvey, et al) are examples of yet another approach to deter unauthorized access to the padlock and associated hasp staple. The devices disclosed in these patents include guards, enclosures or shrouds which surround or enclose all or most of the locking mechanism. Placement and removal of the padlock can be difficult because the access opening to such a padlock enclosure is fairly small in order to prevent insertion of bolt cutters and like tools, and the padlock must be manipulated through this opening to unlock and remove it. In addition, like the devices of the first group of patents discussed above, such special enclosures and guards have to be specially designed as an integral part of the components to be locked together. The devices are not adapted to be fitted to most existing lock shackle/ hasp staple installations without major modifications of the installations.

DISCLOSURE OF THE INVENTION

A padlock shackle and hasp staple protector according to the present invention can be fitted to an existing padlock/hasp staple installation without any need for modification of the installation. The protector completely overlies the shackle and staple and prevents cutting by bolt cutters, chisels, hack saws or the like. It cooperates with the shackle in the locked state of the padlock so that the cover cannot be removed. However, in the unlocked state of the lock, the cover can easily be moved out of engagement with the shackle and lifted away or demounted to provide access to the shackle and hasp staple.

Padlocks of special design are not required, and locking and unlocking of the padlock is easy because the key opening in the lock body is always uncovered and readily accessible. The protector can be used with various configurations of parts to be locked together. It occupies a relatively small mounting area and does not have any protuberances or projections which might pose a risk of injury to users.

In one embodiment the protector includes a cover having an outer wall and inwardly directed side walls adapted to rest upon the hasp and adjacent structure. The walls define a keeper recess having an opening to closely receive the upper portion of the lock body when the padlock is locked. When the padlock is unlocked the shackle legs move to an extended position. This locates the upper portion of the lock body out of possible engagement with the side walls of the protector so that a keeper of the protector can be moved out of engagement with the shackle. This enables demounting of the protector.

The keeper is fixed to the cover within the keeper recess and includes laterally open retainer means which laterally receive the shackle legs in the locked state of the padlock. The retainer means cannot move outwardly relative to the shackle legs, thereby preventing outward movement and demounting of the cover when the padlock is locked.

Lateral movement of the cover is possible when the padlock is in its unlocked state. Such lateral movement moves the cover out of engagement with the shackle legs and frees the protector so that it can be lifted off and separated from the hasp staple and shackle. Only then can the padlock be separated from the hasp staple.

The protector is unique in that it depends for operation upon the changed location of the lock body in the locked and unlocked states of the padlock, in the one case to prevent lateral movement and removal of the cover, and in the other case to enable such movement and removal. The protector is completely separable from the parts to be locked together. If desired, a lanyard or tether can be attached to the protector and secured to the structure associated with the hasp so that the cover cannot be lost when it is removed from its overlying, protective position relative to the shackle and hasp staple.

Other aspects and advantages of the present invention will become apparent from the following more detailed description taken in conjunction with the accompanying drawings.

BEST MODES FOR CARRYING OUT THE INVENTION

Figure 1:
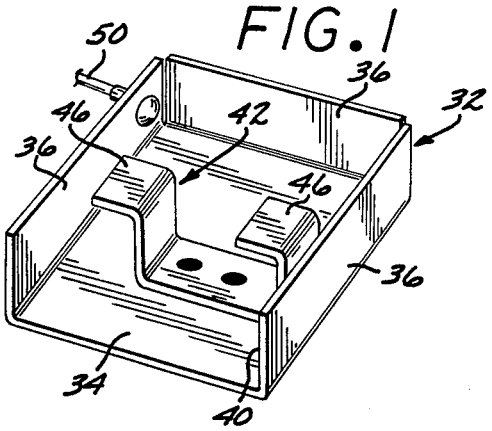
FIG. 1 is a perspective view of the protector of the present invention.

Referring now to the drawings, one form of the present protector is illustrated in association with a conventional padlock 10 having a generally rectangular lock body 12 and a shackle 14 of inverted U-shape. The shackle is passed through a U-shape hasp staple 16 which is fixed by welding or the like to a planar base (not shown) which in turn is fixed to the outer face of a hasp staple part such as a door frame 18.

The hasp staple projects outwardly through a slot 20 in the free extremity of an elongated hasp 22. The hasp 22 is pivotally mounted by a hinge anchorage 24 to a hasp part which in the present instance is a door 26.

The foregoing structure is well known in the art and forms no part of the present invention, the arrangement merely being illustrative of a typical application for the protector of the present invention.

There are a number of ways in which the foregoing conventional installation is vulnerable to tampering by thieves. The free extremity of the hasp overlies the fasteners which extend through the door frame 18 to anchor the hasp staple base in position. This discourages tampering with the fasteners to remove the staple. However, the hasp staple itself can be cut by bolt cutters or hack saws, or it can be pried loose by inserting a tool within the central opening of the hasp staple and prying outwardly. The material of the usual hasp staple is relatively soft and easily cut by bolt cutters. The padlock shackle 14, although made of a better grade of steel, is also no match for bolt cutters.

As will be seen, the present protector fits over the padlock shackle and hasp staple so that they cannot be reached with burglar tools. In addition, the padlock itself plays an important role in preventing removal of the cover when it is locked. When unlocked, the position of the lock body changes to permit removal of the protector.

More particularly, the usual padlock is characterized by a pair of legs 28 and 30, sometimes termed the "pivot" and "capture" legs. When the padlock is unlocked, these legs become extended so that the capture leg 30 is raised or spaced slightly above the upper terminus of the lock body 12. In this position the shackle 14 can be pivoted about the pivot leg 28 to provide clearance for the shackle to be fitted onto or removed from the hasp staple 16.

Such a padlock is locked onto the hasp staple by aligning the capture leg 30 with a capture leg opening (not shown) in the lock body 12. Pushing upwardly upon the base of the lock body urges the shackle against the upper inner surface of the hasp staple, forcing the shackle to move downwardly so that the legs 28 and 30 assume retracted positions within the lock body. In this position the capture leg 30 is engaged by a locking element (not shown) which forms part of the internal lock mechanism, as is well known to those skilled in the art. The significant aspect of this conventional padlock operation is that the locked lock body 12 is located closer to the hasp staple because of the retracting movement of the legs 28 and 30 into the lock body. Conversely, the unlocked lock body is located in a lower position, farther from the staple, by reason of the extending movement of the legs 28 and 30 out of the lock body. The lock body changes its position because the shackle is prevented from moving by virtue of its engagement with the hasp staple. Thus, when the lock is locked the lock body is up, and when the lock is unlocked the lock body drops down. The position of the shackle does not change.

The present protector is uniquely suited to protect existing installations from unauthorized tampering without any need for reworking the installation. For this purpose, the protector includes a generally rectangular cover 32 which is made of a material and a thickness such that it is resistant to attack by bolt cutters, hack saws, chisels, etc. The cover includes a flat or planar outer wall 34 and three inwardly directed integral side walls 36. The cover is preferably made from a single metal plate by deforming or bending three side margins to define the side walls 36. The metal at each of the bend lines is inwardly deformed at spaced intervals to provide integral gusset stays (not shown) to strengthen the side walls against bending.

Figure 6:
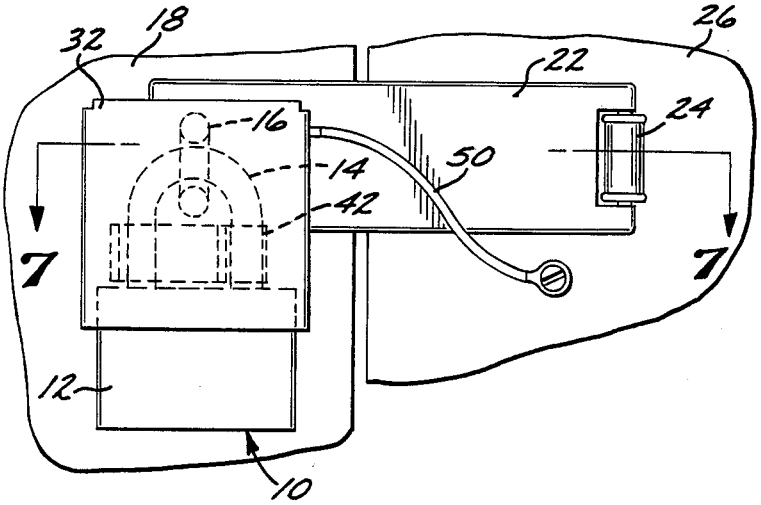
FIG. 6 is a view similar to FIG. 3, but illustrating the padlock in a locked state in which it is partially recessed within the protector, and also illustrating the use of a tether to prevent loss of the protector.
Figure 7:
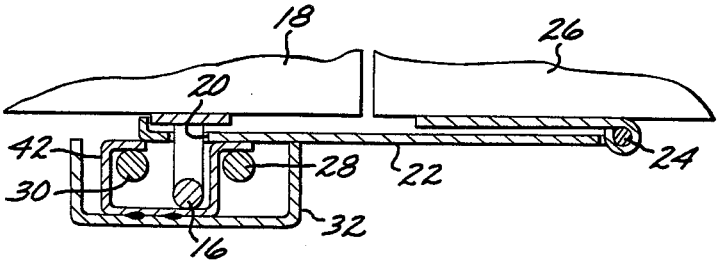
FIG. 7 is a view taken along the line 7—7 of FIG. 6.

The walls 34 and 36 define a keeper recess having a lower opening 40 whose side boundaries are defined by the adjacent, oppositely disposed side walls 36. The width of the opening 40 is made such that in the locked state of the padlock the opening is adapted to closely receive the upper portion of the particular lock body involved, with the sides of the lock body being located immediately adjacent the inner surfaces of the pair of side walls 36, as seen in FIGS. 6 and 7. In this state the lock body sides prevent any lateral movement of the cover relative to the padlock.

The cover is dimensioned and configured so that the height of the lock body upper portion located between the cover side walls in the locked state of the padlock is slightly less than the extent of downward movement which the lock body undergoes when the padlock is unlocked. Consequently, when the padlock is unlocked the cover side walls will be located above and out of possible engagement with the lock body sides. This enables the cover to be moved laterally relative to the lock body, a circumstance whose importance will become apparent in the description which follows.

In its operative position, the cover 32 overlies the hasp staple and shackle, and the inwardly directed side walls bear against the hasp 22 and, depending upon the dimensions of the hasp, upon adjacent structure of the hasp staple base and door frame 18. The depth of the keeper recess is made to closely approximate the thickness of the lock body involved so that significant or appreciable outward pivotal movement of the cover relative to the lock body is not possible in the locked state of the padlock.

The close fitting reception of the upper portion of the lock body in the lower portion of the cover leaves no opening into which burglar tools can be inserted, and the remainder of the cover is closed off by the three side walls. This completely foils entry of such tools into the keeper recess.

The square or rectangular configuration of the cover periphery is not critical. It is possible to make it curvilinear if desired. Moreover, the height and width of the cover can be changed if desired. An increase in the height of the cover to increase the span between the upper side wall and the intersection of the shackle and staple would, for example, make the cover more resistant to outward and upward pivotal movement of the cover in the locked state of the padlock, as will be seen.

A keeper 42 is fixed within the keeper recess and comprises a base welded or otherwise fixed to the inner surface of the cover outer wall 34. It further comprises a pair of retainers or legs 44 integral with and outwardly formed from the keeper base. The legs 44 include laterally directed bends or flanges 46 preferably lying generally in the plane within which the free edges of the side walls 36 lie. The laterally opening legs 44 are adapted to slide under and underlie the shackle legs 28 and 30 when the cover is slid from the position of FIGS. 2 and 4 into the operative position illustrated in FIGS. 3 and 5.

The bend lines defining the legs 44 and flanges 46 incorporate integral gusset stays (not shown) which, like the gusset stays of the cover, reinforce the legs and flanges against bending under stress.

Figure 2:
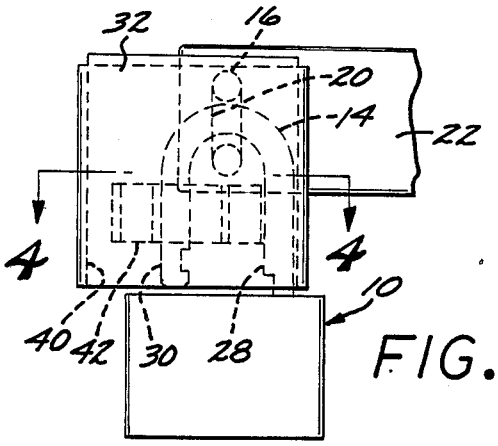
FIG. 2 is a front elevational view of the protector of FIG. 1 in position overlying a padlock shackle and hasp staple, prior to engagement with the shackle legs.
Figure 3:
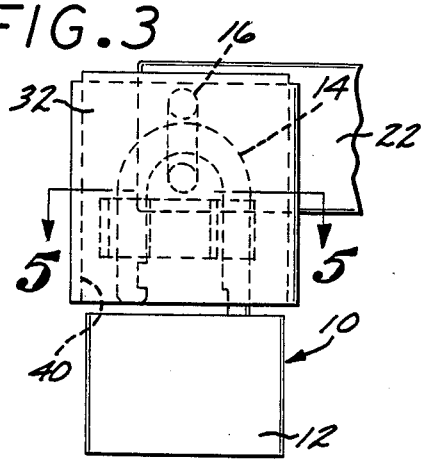
FIG. 3 is a view similar to FIG. 2 showing the protector engaged upon the shackle legs.
Figure 4:
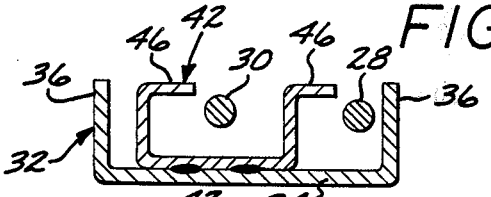
FIG. 4 is an enlarged view taken along the line 4—4 of FIG. 2.
Figure 5:
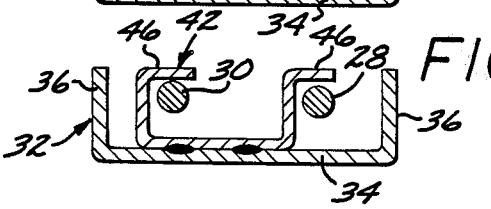
FIG. 5 is an enlarged view taken along the line 5—5 of FIG. 3.

In order to mount the protector in its operative position, the padlock is first disposed through the hasp staple and unlocked. This places the upper terminus of the lock body below the cover side walls so that there is no obstacle to lateral movement of the cover. Next, the cover 32 is placed over the padlock shackle and the hasp staple with the flanges 46 located just to the right of the shackle legs 28 and 30, as seen in FIGS. 2 and 4. The cover is then simultaneously pressed inwardly toward the door frame 18, and slid to the left so that the flanges 46 move underneath the shackle legs, as seen in FIGS. 3 and 5. In this position the protector is centered over the shackle and staple intersection, and the flanges 46 prevent outward movement and separation of the cover from the padlock. Thus, the locked padlock itself prevents removal of the cover.

Once the cover is engaged upon the shackle legs, the padlock is then locked by pressing upwardly upon the lock body in the usual way. This shifts the shackle legs from their extended positions to their retracted positions and places the upper portion of the lock body in the position illustrated in FIGS. 6 and 7. The cover side walls are now located closely adjacent the lock body side walls and prevent any lateral movement of the cover. The cover cannot be removed until the padlock is unlocked.

Laterally opening keeper retainers other than the legs 44 and flanges 46 can be used if desired, so long as they are effective upon engagement with the shackle legs to constrain the cover against outward movement relative to the padlock shackle. However, the keeper 42 illustrated is preferred because of its simplicity and ease of fabrication.

The material of the keeper and its thickness can be selected to suit the particular application at hand, the object being to make the dimensions of the keeper, and the protector in general for that matter, so that they complement the dimensions of the padlock in question.

The protector preferably includes a flexible cable or tether 50 attached in any suitable manner at one end to the cover 32 and at the opposite end to the door 26, as seen in FIGS. 1 and 6. This prevents loss of the protector when it is removed or demounted, as illustrated in FIG. 1.

In its operative or mounted position the cover prevents intrusion into the keeper recess of cutting tools such as bolt cutters and hack saws. Further, interengagement of the cover and the shackle legs deters upward prying of the cover with a crowbar or the like. If desired, the size of the cover can be increased to locate the upper terminus of the cover at a greater distance from the point of intersection of the shackle and the hasp staple, and this would increase the resistance to upward prying of the cover.

From the foregoing it will be appreciated that the present padlock shackle and hasp staple protector is uniquely adapted to provide an economical and inexpensive means for restricting unauthorized access to a shackle and staple. The protector is relatively compact, convenient to install, permits use of a conventional padlock and hasp staple, and it can be fitted to existing lock installations without any need for use of specialized hasps or lock bodies.

Various modifications and changes may be made with regard to the foregoing detailed description without departing from the spirit of the invention.

What is claimed is:

1. A protector for a padlock having a lock body and a shackle of inverted U-shape adapted to pass through a hasp staple to secure together a hasp part and a hasp staple part, the shackle being characterized by a pair of legs having retracted and extended positions which correspond, respectively, to the locked and unlocked states of the padlock, the protector comprising:

a cover having an outer wall to overlie the hasp staple and the shackle, the cover further having inwardly directed side walls, the outer wall and the side walls defining a keeper recess having an opening to closely receive the upper portion of the lock body in the locked state of the padlock and thereby deny access to the hasp staple and the shackle, the cover being adapted for location out of possible engagement with the upper portion of the lock body in the unlocked state of the padlock to free the cover for lateral movement; and a keeper fixed to the cover within the keeper recess having a keeper element welded to the outer wall of the cover and having a pair of inwardly extending legs whose free extremities are laterally directed to underlie the shackle legs in the locked state of the padlock whereby the shackle legs prevent outward movement of the cover from the hasp staple and the shackle and adapted to predetermined movement of the cover to disengage the legs and thereby permit outward movement of the cover from the hasp staple and the shackle.

2. In combination with a hasp staple part including a hasp staple, a hasp part including a hasp having a slot through which the hasp staple projects; and a padlock including a lock body having an upper portion of predetermined width, and further including a shackle of inverted U-shape extending through the hasp staple to secure together the hasp staple part and the hasp part, the shackle being characterized by a pair of legs having retracted and extended positions relative to the lock body which corresponds, respectively, to the locked and unlocked states of the padlock, an improved padlock shackle and hasp staple protector comprising:

a cover having an outer wall overlying the hasp staple and the shackle, and further inwardly directed side walls one of which extends toward and contacts a position hasp part, the outer walls and the side walls defining a keeper recess having an opening whose width is slightly greater than the width of the lock body upper portion to receive the lock body upper portion in the lock state of the padlock, yet preventing lateral movement of the cover relative to the padlock, the lock body upper portion in the unlocked state of the padlock being out of possible engagement with the cover to free the cover for lateral movement; and a keeper fixed to the cover within the keeper recess and including laterally extending retainer means engaging the shackle legs in the locked state of the padlock and denying access to the hasp staple and the shackle by preventing outward movement and separation of the cover from the padlock, the cover being laterally moveable in the unlocked state of the padlock to disengage the retainer means from the shackle legs to permit separation of the cover from the padlock and enable access to the hasp staple and the shackle.

3. A combination according to claim 2 wherein the cover is generally rectangular, and the side walls enclose three sides of the keeper recess.

4. A combination according to claim 2 wherein the outer wall of the cover overlies the lock body upper portion in the locked state of the padlock.

5. A combination according to claim 2 wherein the keeper comprises a keeper element welded to the outer wall of the cover and having a pair of inwardly extending legs whose free extremities are laterally directed and underlie the shackle legs in the locked state of the padlock whereby the shackle legs prevent outward movement and separation of the cover from the padlock.

6. A combination according to claim 2 and including a tether attached to the cover and to one of the hasp and hasp staple parts to prevent loss of the cover on separation from the padlock.

* * * * *

UNITED STATES PATENT AND TRADEMARK OFFICE

CERTIFICATE OF CORRECTION

PATENT NO. : 4,843,845

DATED : July 4, 1989

INVENTOR(S) : Lloyd R. Poe

It is certified that error appears in the above-identified patent and that said Letters Patent is hereby corrected as shown below:

Column 1, line 30, delete "add" and insert --and--;

Column 7, line 6, delete "position" and insert --portion of the--;

Column 7, line 6, delete "walls" and insert --wall--.

Signed and Sealed this

Third Day of July, 1990

*Attest:*

*Attesting Officer*

HARRY F. MANBECK, JR.

*Commissioner of Patents and Trademarks*